US005772248A

United States Patent [19]

Phillips

[11] Patent Number: 5,772,248

[45] Date of Patent: Jun. 30, 1998

[54] DOCUMENT WITH TAMPER AND COUNTERFEIT RESISTANT RELIEF MARKINGS

[75] Inventor: George K. Phillips, Paso Robles, Calif.

[73] Assignee: Verify First Technologies, Inc., Paso Robles, Calif.

[21] Appl. No.: 568,587

[22] Filed: Dec. 7, 1995

[51] Int. Cl.[6] ..... B42D 15/00

[52] U.S. Cl. ..... 285/91; 283/72

[58] Field of Search ..... 283/72, 81, 86, 283/93, 94, 91, 105, 57–59, 901–904, 61, 62; 281/2, 5; 40/446, 453, 299; 428/43

[56] References Cited

U.S. PATENT DOCUMENTS

| | | | |
|---|---|---|---|
| 1,998,237 | 4/1935 | Himmell . | |
| 3,282,720 | 11/1966 | Oleksiw . | |
| 3,802,724 | 4/1974 | Gosnell | 283/9 |
| 4,025,673 | 5/1977 | Reinnagel | 428/29 |
| 4,066,280 | 1/1978 | La Capria | 283/8 |
| 4,082,426 | 4/1978 | Brown | 350/105 |
| 4,151,666 | 5/1979 | Raphael et al. | 40/2.2 |
| 4,163,570 | 8/1979 | Greenaway | 283/8 |
| 4,168,088 | 9/1979 | Somlyody | 283/8 |
| 4,175,774 | 11/1979 | Tonges et al. | 283/6 |
| 4,175,776 | 11/1979 | Ranauro | 283/8 |
| 4,184,700 | 1/1980 | Greenaway | 283/6 |
| 4,227,719 | 10/1980 | McElligott et al. | 283/6 |
| 4,265,469 | 5/1981 | Mowry et al. | 283/8 |
| 4,303,307 | 12/1981 | Tureck | 350/276 |
| 4,307,899 | 12/1981 | Hoppe | 283/7 |
| 4,341,404 | 7/1982 | Mowry et al. | 283/8 |
| 4,351,547 | 9/1982 | Brooks, II | 283/8 |
| 4,455,039 | 6/1984 | Weitzen et al. | 283/83 |
| 4,506,916 | 3/1985 | Kuhl | 283/91 |
| 4,522,429 | 6/1985 | Gardner et al. | 283/91 |
| 4,534,398 | 8/1985 | Crane | 162/103 |
| 4,564,409 | 1/1986 | Kuhl | 283/94 |
| 4,568,141 | 2/1986 | Antes | 281/91 |
| 4,576,439 | 3/1986 | Gale et al. | 283/91 |
| 4,579,370 | 4/1986 | Corwin et al. | 283/72 |
| 4,588,212 | 5/1986 | Castagnoli | 283/91 |
| 4,629,630 | 12/1986 | Devrient | 427/7 |
| 4,715,623 | 12/1987 | Roule et al. | 283/91 |
| 4,795,894 | 1/1989 | Sugimoto et al. | 235/468 |
| 4,867,481 | 9/1989 | Gundjian | 283/91 |
| 4,869,532 | 9/1989 | Abe et al. | 283/88 |
| 4,892,385 | 1/1990 | Webster, Jr. et al. | 350/162.23 |
| 4,988,126 | 1/1991 | Heckenkamp et al. | 283/92 |

(List continued on next page.)

FOREIGN PATENT DOCUMENTS

| | | | |
|---|---|---|---|
| 650304 | 6/1992 | Australia | 283/72 |
| 965125 | 3/1975 | Canada | 283/901 |
| 93022146 | 11/1993 | WIPO | 283/72 |

OTHER PUBLICATIONS

McGarry, Dennis, "Document Security", *Technical Update–National Business Forms Association,* Dec. 1, 1990, pp. 3–8.

National Business forms Association, "Watermarked and Non–Impact Papers", *Technical Report*, Aug. 17, 1987, vol. 1, No. 8, T.U. #32 (LLB), pp. 1–3.

The Standard Registry Company, "Making It Easy for People to Be Honest—Three Steps to Document Security", *Standard Register*, Form No. 5463 4.89–1, 1990, pp. 1–6.

McLoone, Sharon, "Inks That Are Mightier Than the Counterfeiter", *Form*, May 1995, pp. 88, 90, 93.

Steven S. Scaman et al., "Security Indicator Inks Gain Market Prominence", *Flexo*, Dec. 1994, pp. 14, 16–17.

*Primary Examiner*—Willmon Fridie, Jr.
*Attorney, Agent, or Firm*—Lyon & Lyon LLP

[57] ABSTRACT

A tamper and counterfeit resistant security maker comprises relief impressions having a plurality of distinct and contrasting relief structures, wherein a first relief structure comprises a background pattern and at least a second relief structure comprises a latent image pattern containing informational content. The relief patterns comprise different optical properties which facilitates the viewing of a latent image pattern at certain angles.

9 Claims, 3 Drawing Sheets

U.S. PATENT DOCUMENTS

| | | | |
|---|---|---|---|
| 5,029,901 | 7/1991 | Dotson et al. | 462/8 |
| 5,044,707 | 9/1991 | Mallik | 359/2 |
| 5,093,184 | 3/1992 | Edwards | 428/192 |
| 5,137,304 | 8/1992 | Silverschotz | 283/100 |
| 5,149,140 | 9/1992 | Mowry, Jr. et al. | 283/93 |
| 5,190,318 | 3/1993 | Mantegazza | 283/82 |
| 5,197,765 | 3/1993 | Mowry, Jr. et al. | 283/93 |
| 5,271,645 | 12/1993 | Wicker | 283/92 |
| 5,344,192 | 9/1994 | Phillips | 283/91 |
| 5,454,598 | 10/1995 | Wicker | 283/67 |
| 5,582,103 | 12/1996 | Takana et al. | 283/91 |

DOCUMENT WITH TAMPER AND COUNTERFEIT RESISTANT RELIEF MARKINGS

BACKGROUND OF THE INVENTION

1. Field of the Invention

The field of the invention pertains to the detection of the unauthorized alteration, duplicating or counterfeiting of valuable documents. In particular, the field of the present invention pertains to the imprinting of original documents so that an alteration or reproduction of the document is readily discernable from the original document.

2. The Related Art

Presently known approaches for recognizing altered, duplicate or counterfeit copies of original documents have generally sought to prevent alteration, duplication or counterfeiting of documents by physical alteration, electronic scanning or xerographic photocopying by printing information on the document in specially designed inks or other printing materials so that the printed information can be viewed on the original, but due to the unique color, texture, or reflective properties of the printed information on the altered or counterfeited copy, will be readily discernable from the original.

For example, U.S. Pat. No. 4,066,280 to LaCapria describes a document upon which is printed a specularly reflective coloring material such as powdered aluminum, which is not accurately reproduced by color copiers. The duplicate image will appear in different colors than on the original.

Similarly, U.S. Pat. No. 4,988,126 to Heckenkamp et al. describes an original document having surface relief in the form of embossed characters. A luminescent substance is formed into raised or depressed areas of the surface relief. The reflective properties of the surface relief render the original readily discernable from a photocopy which lacks the surface relief.

U.S. Pat. No. 4,082,426 describes retroreflective sheet materials formed of a monolayer of microsphere-lenses overlaying a specularly reflective layer coated over a polymeric material. A transparent image layer of varying thickness permits light rays to be transmitted to and reflected by the specularly reflective layer behind the image layer. The varying thickness of the image layer and the spacing between the specularly reflective layer and the microsphere-lenses changes the reflective characteristics of the sheeting, so that markings on the sheet are visible only from certain angles under retroreflective viewing conditions.

U.S. Pat. No. 4,892,385 to Webster, Jr. et al. describes an authenticating device which can be bonded to the surface of a document to identify an original document.

Another approach has been to provide specially manufactured copy-resistant paper upon which information of any kind can be printed using conventional processes and inks. For example, U.S. Pat. No. 4,867,481 to Gundjian describes copy-resistant paper having a two-color grid-like pattern printed over its surface, with each color having the same spectral profile but different spectral response. U.S. Pat. No. 4,303,307 to Tureck et al. describes a paper substrate coated with specially sized and spaced beads which break up incident light emitted by a photocopier. U.S. Pat. No. 5,093,184 to Edwards describes security paper having elongated metallic elements embedded in the paper.

Yet another approach has been to provide specially designed inks or other printing materials having different or unique color or reflective properties. For example, U.S. Pat. No. 5,271,645 to Wicker describes a color-copier resistant pigment consisting of print stuff mixtures obtained by mixing commercially available pigments with fluorescence compound.

U.S. Pat. No. 4,869,532 to Abe et al. describes a print produced by printing or coating an infrared reflective coloring agent and another printing ink containing an infrared absorptive coloring agent in combination on a base material, to produce visually-recognizable information along with other information recognizable with the aid of infrared lighting.

U.S. Pat. No. 4,025,673 and U.S. Pat. No. 3,887,742 to Reinnagel describe prevention of photocopying by selection of different color or color filter combinations for the text and background.

U.S. Pat. No. 4,175,776 to Ranauro describes a document in which the text and background are characterized by different optical reflectivities for incident visible light and which are substantially non-absorbing with respect to incident light having wavelengths within the response spectrum of color xerographic copying machines. When the document is photocopied, the incident light of the photocopier produces a uniform reflected pattern over the indicia which causes the indicia to "drop out" of the copy.

U.S. Pat. No. 4,522,429 to Gardner et al. discloses a document upon which text is printed upon colored paper having a reflection spectral response of less than about ten percent for light of below 600 millimicron wavelength, so that the color is sufficiently contrasting with the text to be visible when viewed under white light, but cannot be successfully photocopied.

SUMMARY OF THE INVENTION

The present invention provides an advantageous approach to the prevention and detection of alteration, duplication or counterfeiting by providing a tamper resistant document marker which can be readily visually identified on an original document, but which cannot be exactly duplicated by commercially available document copier devices.

The present invention comprises a pattern of relief impressions on a document having a plurality of distinct and contrasting relief structures, which forms a visible image when observed at the correct viewing angle(s), but which is "hidden" when observed at an incorrect viewing angle. In the preferred embodiment, a latent image is formed by the contrasting optical properties of an image relief structure which is contrasted to the optical properties of a background relief structure. The contrasting image relief structure becomes visible against the background relief structure when observed at the proper viewing angles. The image relief structure can be fabricated as a series of alpha-numeric characters to provide informational content to the contrasting visible image.

BRIEF DESCRIPTION OF THE DRAWING FIGURES

DETAILED DESCRIPTION OF THE PREFERRED EMBODIMENT

Figure 1:
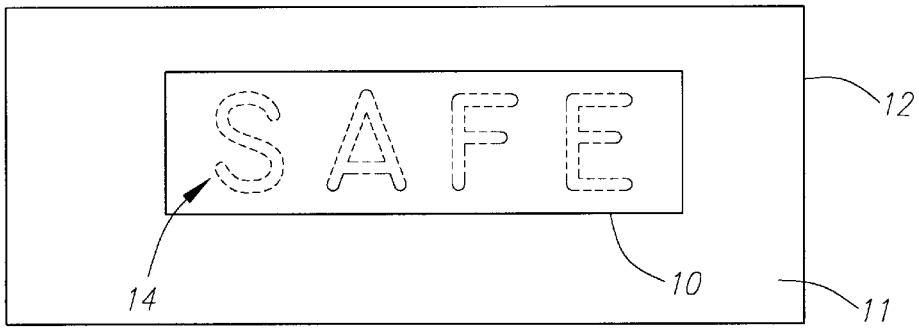
FIG. 1 is a top view of a counterfeit-resistant document according to a preferred embodiment of the present invention.

FIG. 1 depicts the invention as preferably used to create a tamper/counterfeit-resistant document 12 comprising a substrate 11 and a security tamper resistant overlay marker 10 according to a preferred embodiment of the present invention. The substrate 11 is preferably of paper stock; however, any material suitable to the application may be used without departing from the scope of the present invention. It is anticipated that the present invention will be particularly suitable for checks and other documents of value, although the present invention is not limited to these applications and can be used in any application in which it is desirable to be able to discern an original from an alteration or reproduction.

Security tamper resistant overlay marker 10 is preferably formed of at least one layer of tamper resistant reflective material of uniform height which is applied to substrate 11. Materials, such as materials with optical variable metallic property or plastic or polymeric materials, may be employed depending on the particular application without deviating from the scope of the present invention. The security tamper resistant overlay marker 10 is preferably comprised of tamper resistant material which is either opaque, metallic, translucent or transparent. To provide an increase in reflectivity, the surface of security overlay marker 10 is preferably coated with a glossy plastic film or an optical variable reflective metallic coating, which may also serve to protect the surface of security overlay marker 10 from wear or damage. Preferably the security overlay marker 10 is comprised of pre-formed sheets of overlay marker material which are affixed to substrate 11 with adhesives.

Figure 2:
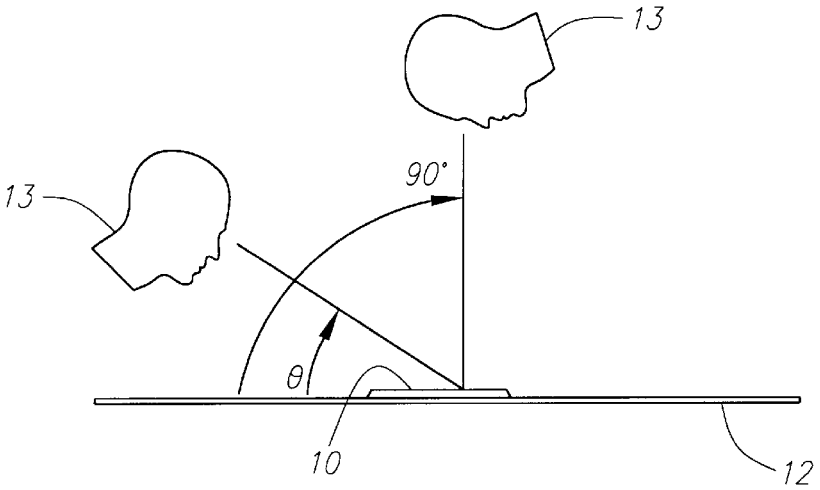
FIG. 2 is a diagram of alternative viewing angles for an embodiment of the present invention.

As outlined in phantom in FIG. 1, the surface of security overlay marker 10 comprises relief impressions which form a latent image 14, shown in FIG. 1 as the alphanumeric characters "SAFE". The image 14 is not readily apparent when an observer 13 is viewing the document 12 at an angle approximately perpendicular to the surface of the document 12. In the preferred embodiment, the latent image 14 is thus "hidden" when an observer's viewing angle is at an angle of approximately 90 degrees relative to the surface of security tamper resistant overlay marker 10 (FIG. 2). The latent image 14 becomes "visible", i.e., more readily apparent, when the viewing angle is in the range of approximately 0° to 90° relative to the surface of the security overlay marker 10. Angle θ is preferably less than 90°, and more preferably comprises a range of viewing angles from approximately 20° to 70° at which the image 14 is more readily apparent. Factors which determines this range of viewing angles include the exact viewing conditions, the material comprising security overlay marker 10, the wavelengths of the incident light rays, the incoming angle of the incident light rays, and the image relief pattern 14 imprinted on the security overlay marker 10.

Figure 3:
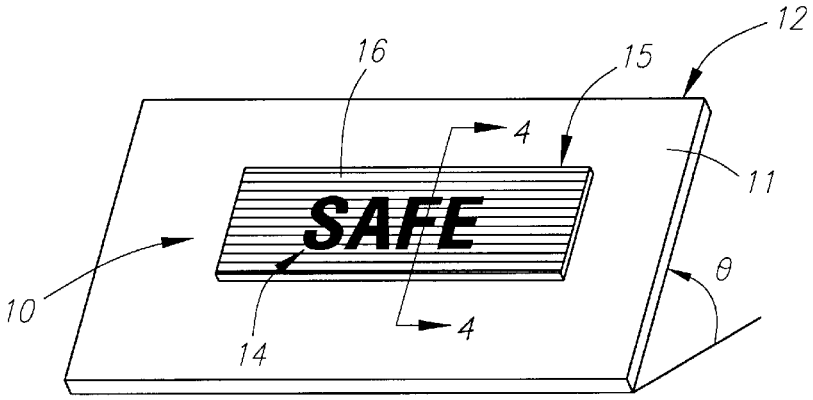
FIG. 3 shows the document of FIG. 1 viewed from an angle θ.

FIG. 3 depicts the document 12 and security tamper resistant overlay marker 10 of FIG. 1 according to a preferred embodiment, which has been rotated to an angle θ, showing a latent image 14 visible against a contrasting background pattern. In this preferred embodiment, security tamper resistant overlay marker 10 comprises a relief impression having at least two distinct and contrasting relief structures. The first relief structure is a background structure 15 which generally extends over a substantial portion of the surface of security tamper resistant overlay marker 10. The second relief structure is a contrasting image structure 18 which is generally formed within the boundaries of the background structure 15 to provide informational content to the security overlay marker 10. In the preferred embodiment, the latent image 14 comprises a series of relief impressions having a rectilinear background structure 15 forming the background pattern, with a contrasting image structure 18 forming a series of alphanumeric image patterns which combine to form a document verification word such as "SAFE" or "GENUINE". It is within the scope of the present invention to employ non-alphanumeric image patterns to provide the informational content of latent image 14, i.e. pictorial impressions or numeric impressions. A plurality of contrasting or different image relief structures may be employed in the present invention, each of which may be viewable at different observable viewing angles than a first image relief structure.

Figure 4:
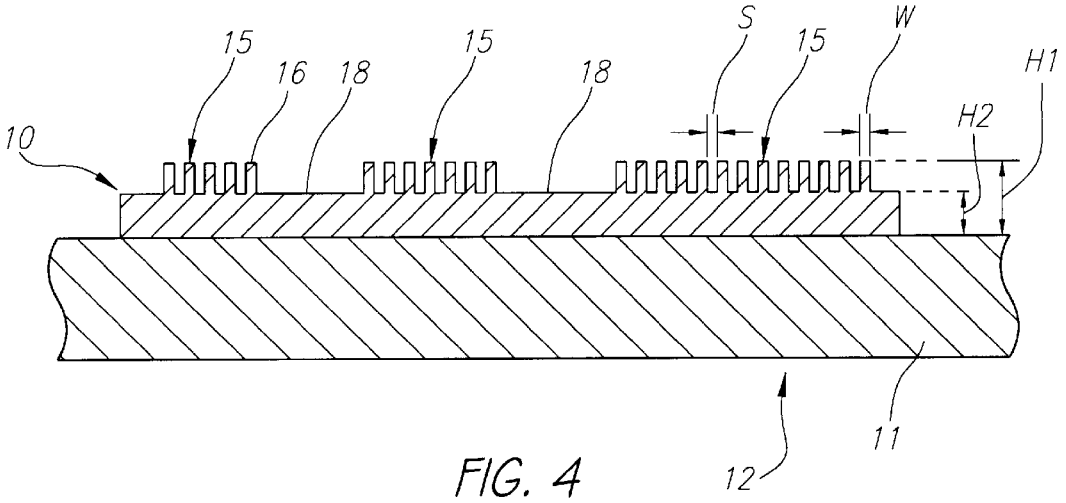
FIG. 4 is a cross-sectional view of a counterfeit-resistant document having a security tamper resistant overlay marker according to a preferred embodiment of the present invention.

FIG. 4 is a cross-sectional view of the security tamper resistant overlay marker 10 of FIG. 3 at line A—A, showing the general relief structure of latent image 14. Background structure 15 is preferably formed by a series of parallel raised markings 16 which extend the length of security tamper resistant overlay marker 10 except in the portions in which the contrasting image structure 18 resides. Each marking 16 preferably comprises a generally uniform height H1 and width W and spacing S. Because of the surface structure formed by raised markings 16, incident light rays which are projected onto the markings 16 are reflected and modified by a diffractional and/or diffusional process. The height, width, and spacing of the markings 16 in FIG. 4 are for purposes of illustration only; the actual dimensions of the relief structure of security tamper resistant overlay marker 10 are chosen to bring about desired optical effects on incident light rays which strike the security tamper resistant overlay marker 10, as explained in more detail below. It is contemplated that other background patterns may be employed in the present invention in place of the described rectilinear background pattern, and these other background patterns are expressly within the scope of the present invention.

The latent image 14 is preferably formed on the surface of overlay marker 10 with image structure 18 of height H2 whose borders are in the shape of the desired image. Image structure 18 is comparatively smooth with a light-reflecting surface having surface irregularities which are preferably small in comparison to the wavelength of visible light. It is the contrast between the optical properties of image structure 18 and the optical properties created by the raised markings 16 that creates the latent image 14 and which renders the latent image 14 visible when document 12 is viewed at angle θ.

Figure 5:
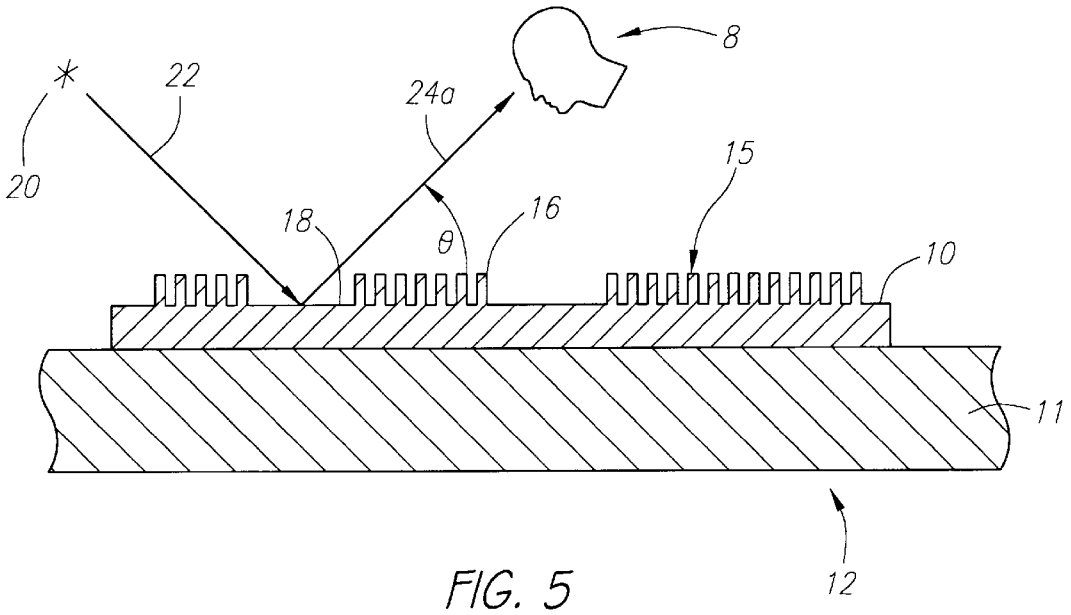
FIGS. 5 and 6 show the interaction of incident and reflective light rays on the security tamper resistant overlay marker of FIG. 4.
Figure 6:
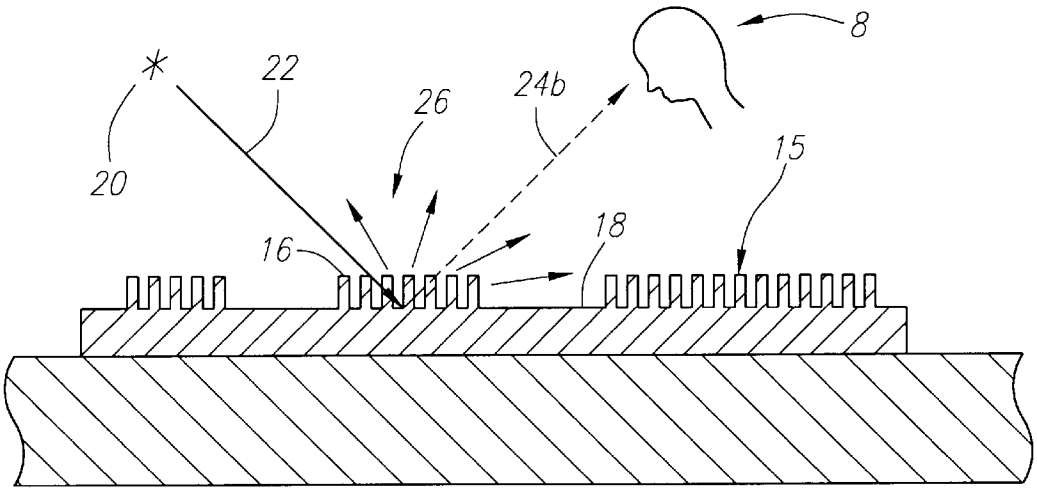

As shown in FIGS. 5 and 6, an observer 8 would typically view the security tamper resistant overlay marker 10 at a relative angle θ, with a light source 20 projecting incident light rays 22 at security tamper resistant overlay marker 10.

With respect to incident light rays 22 which project onto image structure 18 (FIG. 5), the reflected light rays **24*a* are preferably without significant diffractional effects to the amplitude or phase of the incident light, as compared to the reflected light rays 24*b* (FIG. 6) from the background structure 15. In addition, light rays 24*a* more specularly reflect to observer 8, as compared to light rays 24*b* reflected from background structure 15, because the relative smoothness of image structure 18 causes less diffusion of the incident light rays 22**.

With respect to incident light rays 22 which project onto the background structure 15 (FIG. 6), the reflected light rays 24*b* are reflected to observer 8 with a character different than that of reflected light rays 24*a* from image structure 18. In general, two types of light modifications may occur when the incident light rays 22 are projected onto the raised markings 16 of the background structure 15. First, the height and spacing of the raised markings 16 may be such that a diffractional interference pattern is formed wherein the amplitude and/or wavelength of incident light rays 22 are modified in the reflected light rays 24*b*. The diffractional effects can be controlled by modifying the spacing S, width W, and height H1 of the raised markings 16 to produce reflected light rays 24*b* containing desired optical characteristics. Second, the surface irregularities formed by the raised markings 16 may diffuse the incident light rays 22, such that certain incident light rays 22 which strike the raised markings 16 will scatter, reflecting light rays 26 at angles not directed towards observer 8. The optical effect of this diffusion of light rays allows the rectilinear pattern of the background structure 15 to be clearly visible at the proper viewing angles.

The latent image 14 is thus readily visible at angle θ because of the stark contrast between the intensity and character of the reflected light rays 24*a* of image structure 18 and the reflected light rays 24*b* of the background structure 15. The contrast between the image structure 15 and the background structure 15 can be enhanced by manipulating the particular surface features of either relief structures 15 or 18. For example, the spacing S, height H1 or width W of the markings 16 can be altered to change the diffractional and/or diffusional effects of the markings 16 on incident light rays 22. In addition, the height H2 and smoothness of the image structure 18 can changed to increase or decrease the relative reflectivity of the image structure 18.

Figure 7:
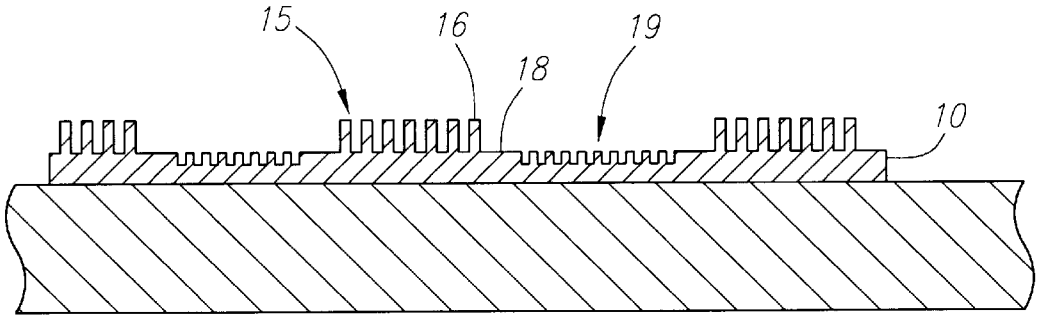
FIG. 7 is a cross-sectional view of a two image security tamper resistant overlay marker according to the present invention.

As shown in FIG. 7, a second image can be created in the security overlay marker 10 by forming an additional internal relief structure 19 in the image relief structure 18.

The relief impressions on the surface of security tamper resistant overlay marker 10 are preferably formed by embossing or debossing the surface of security tamper resistant overlay marker 10 with a patterned die. The application of the patterned die with sufficient pressure on the surface of overlay marker 10 causes the correct pattern of markings 16 and image structure 18 to form on the overlay marker 10. In the preferred embodiment, the die is heated prior to applying pressure to a tamper resistant overlay marker 10 to facilitate the imprinting of a desired relief impression.

Although this particular invention has been described in detail with particular reference to the preferred embodiments as illustrated and described herein, as would be obvious to those skilled in the art after a review of the drawings and specification, various modifications may be made which are encompassed by the present invention and the scope of the invention is not to be restricted except within the scope and spirit of the appended claims.

What is claimed is:

1. A tamper and counterfeit resistant document comprising:

a substrate; and a security tamper resistant overlay marker applied to said substrate, said security tamper resistant overlay marker comprising a first latent image, said first latent image comprising an image relief structure, said image relief structure comprising a flat portion and a ridge portion, said ridge portion comprising a first series of ridges, said flat portion defining a first plane; each of said ridges of said first series of ridges having a top, said tops of said ridges of said first series of ridges defining a second plane, said second plane located above said first plane with respect to said substrate; and a second latent image comprising an internal image relief structure comprising a second series of ridges;

said second series of ridges formed in said flat portion of said internal image relief structure, each of said ridges of said second series of ridges having a bottom, said bottom of said ridges of said second series of ridges defining a third plane, said third plane below said first plane with respect to said substrate.

2. The tamper and counterfeit resistant document of claim 1 wherein said ridges of said first series of ridges are substantially parallel to said ridges of said second series of ridges, and wherein said first series of ridges are complementary to said second series of ridges.

3. The tamper and counterfeit resistant document of claim 1 wherein said ridges of said first series of ridges are nonintersecting and said ridges of second series of ridges are nonintersecting.

4. The tamper and counterfeit resistant document of claim 1 wherein said second series of ridges comprise informational content in the form of at least one alpha-numeric character.

5. The tamper and counterfeit resistant document of claim 1 wherein said second series of ridges is specular.

6. The tamper and counterfeit resistant document of claim 1 wherein said security tamper resistant overlay marker comprises a thermoplastic material.

7. The tamper and counterfeit resistant document of claim 1 wherein said security tamper resistant overlay marker comprises a metallic material.

8. The tamper and counterfeit resistant document of claim 1 wherein said security tamper resistant overlay marker comprises a dye, ink or toner receptive material.

9. The tamper and counterfeit resistant document of claim 1 wherein said security tamper resistant overlay marker comprises a glossy coating.

* * * * *